United States Patent [19]

Matthews

[11] 4,143,740

[45] Mar. 13, 1979

[54] MODULAR STAIRWAY SYSTEM FOR INSTALLATION ON STRUCTURES HAVING NON-LINEAR WALLS

[75] Inventor: Wesley D. Matthews, Mechanicsburg, Ill.

[73] Assignee: Floyd G. Matthews, Mechanicsburg, Ill.

[21] Appl. No.: 864,242

[22] Filed: Dec. 27, 1977

[51] Int. Cl.[2] ..... E04F 11/04

[52] U.S. Cl. ..... 182/93; 52/187; 403/312

[58] Field of Search ..... 182/93; 52/187, 188, 52/182, 183; 403/310, 312

[56] References Cited

U.S. PATENT DOCUMENTS 1,173,074 2/1916 Williams ..... 52/187 X

*Primary Examiner*—Price C. Faw, Jr.
*Assistant Examiner*—Conrad L. Berman
*Attorney, Agent, or Firm*—Kirkland & Ellis

[57] ABSTRACT

This application disclosed a modular stairway system for circular structures or other structures having non-linear walls. The invention comprises a plurality of first stringer means, a plurality of first connecting means for joining the first stringers, a plurality of second stringer means horizontally spaced from and parallel to the first stringer means, and a plurality of adjustable second connecting means for adjustably joining the second stringers such that the first and second stringers conform to the curvature of the structure. A plurality of stairs are horizontally interposed between the first and second stringers, and a stair mounting means for securing the stairs to the first and second stringers are provided. Also provided are mounting bracket means securing the first stringers to the structure and brace means for supporting the second stringer to the structure, whereby there is obtained a reversible sectional stairway system which can be easily installed on circular structures or other structures having non-linear walls.

7 Claims, 6 Drawing Figures

156
166
162
76
74
78
88
58
63
64
84
70
66
2
68
60
62
156
162
166
44
54
88
56
52
74
76
78
86
82
80
92
90
58
63
84
64
66
70
68
62
72
86
92
82
90

MODULAR STAIRWAY SYSTEM FOR INSTALLATION ON STRUCTURES HAVING NON-LINEAR WALLS

BACKGROUND OF THE INVENTION

1. Field of the Invention

This invention relates to a modular stairway system and more particularly relates to a reversible sectional stairway system which can be easily assembled and installed on circular structures of different diameters or on other structures having non-linear walls.

2. Description of the Prior Art

It has heretofore been considered impractical, if not impossible, to prefabricate stairways for circular structures because of the large range of diameters and therefore different radii of curvature. In addition, previous attempts to prefabricate individual components have usually required custom installation on the structure. This custom installation has usually involved welding of the individual components, both together and to the structure. Such stairways also demonstrated the disadvantage of being principally supported by the welds on the wall of the structure. Furthermore, the significant amount of labor involved in installing the stairway is expensive and time consuming.

In another type of prior art construction, there is provided a stairway which is attached to the top of the structure and which slopes downwardly away from the tank and is anchored to the ground at a substantial distance from the structure. This construction is cumbersome and occupies an excessive amount of ground space.

Other previous stairway constructions have consisted of a first stringer, either attached to or spaced from the structure wall, which conformed to the curvature thereof, with a second stringer corresponding in shape and curvature to the first stringer horizontally spaced therefrom. Between the stringers is interposed a plurality of stairs forming the steps of the stairway. The disadvantage of this type of stairway is that since the stringers conform to the curvature of the circular structure they must be either custom built or prefabricated for circular structures of fixed diameter. Therefore, it would be a decided improvement over the prior art to have a stairway system which utilized modular component sections, which could be prefabricated to fit circular structures of varying diameters, and which could be conveniently and inexpensively assembled and installed on the structure.

Accordingly, a primary object of this invention is to provide a practical stairway system which utilizes prefabricated straight modular component sections which can be installed on circular structures of different diameter and therefore different radii of curvature in either a clockwise or counter-clockwise direction.

Another object is to provide a stairway system which can be easily and inexpensively manufactured, shipped disassembled and easily assembled and installed on a circular structure or other structure having curved or non-linear walls, with a minimum of labor and without the necessity of welding.

A further object is to provide a stairway system in which individual components can be conveniently and economically replaced due to the sectional construction and bolted installation.

A still further object is to provide a stairway system in which the sectional components have dimensions and corresponding hole punchings that match the bolt spacings on standardized circular structures such as grain storage bins.

A related object is to provide a stairway system which is safer to climb than the ladder systems which are frequently utilized due to the lack of inexpensive prefabricated stairway systems.

SUMMARY OF THE INVENTION

The foregoing and other objects, advantages and features of the present invention may be achieved with a prefabricated modular stairway system comprising a plurality of first stringer means, a plurality of first connecting means for joining the first stringers, a plurality of second stringer means horizontally spaced from and parallel to the first stringer means, and a plurality of adjustable second connecting means for adjustably joining the second stringers such that the first and second stringers conform to the curvature of the structure. A plurality of stairs horizontally interposed between the first and second stringers and stair mounting means for securing the stairs to the first and second stringers are provided. Also provided are mounting bracket means for securing the first stringers to the structure and brace means for supporting the second stringer to the structure, whereby there is obtained a reversible sectional stairway system which can be easily installed on structures having curved or non-linear walls.

The stairway system is also provided with a platform section and a plurality of balusters and handrails for mounting on the stairway and platform sections.

DETAILED DESCRIPTION OF THE PREFERRED EMBODIMENT

In accordance with the present invention, there is obtained a practical stairway system which utilizes prefabricated straight modular component sections and which can be easily assembled and installed on circular structures of different diameters and radii of curvature, or other structures having non-linear walls, in either a clockwise or counterclockwise direction.

Figure 2:
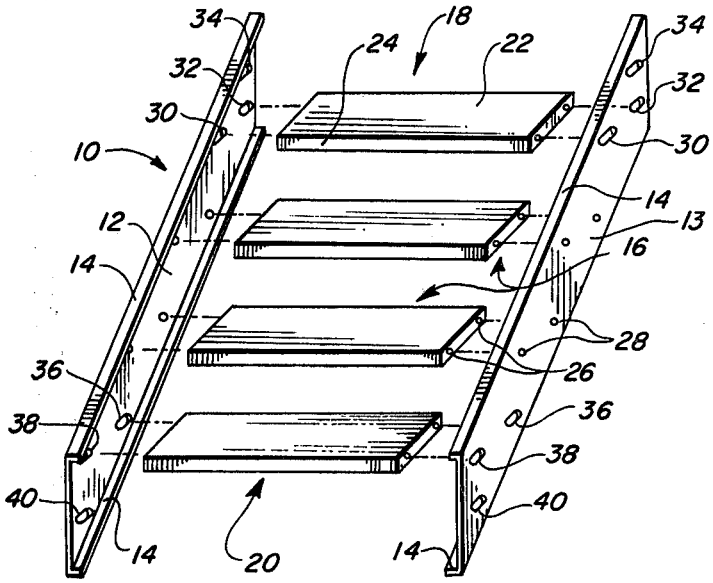
FIG. 2 is an exploded perspective view of a stairway section in accordance with this invention.

Referring now to the drawings with specific reference to FIG. 2, a stairway secton 10 is comprised of a first stringer 12 and a second stringer 13 of sheet metal of uniform thickness and having inwardly turned flanges 14 formed on the top and bottom thereof. First stringer 12 is disposed on the side of the stairway 10 nearest the wall of the circular structure. Second stringer 13 is disposed on the opposing or outer side of the stairway 10. Horizontally interposed between the parallel first and second stringers 12, 13 are a plurality of intermediate stairs 16 along with an uppermost stair 18 and a bottommost stair 20. Each stair 16, 18, 20 is formed from sheet metal and is comprised of a tread portion 22 and a downward flange portion 24 which surrounds the tread portion 22 on all sides. The end flanges 24 on the stair are provided with holes 26 which align with corresponding holes 28 in the first and second stringers 12, 13. The stairs 16 are secured to the stringers 12, 13 by means of four bolts (not shown) which pass through holes 26 in stair 16 and holes 28 in stringers 12, 13. The holes 30, 32 for the top stair 18 and holes 36, 38 for the bottom stair 20 of each section are slotted for a purpose to be hereinafter described.

Substantially, any suitable material may be employed in fabricating the stringers 12, 13 and stairs 16, 18, 20, but galvanized steel has been found to be particularly satisfactory.

Figure 3:
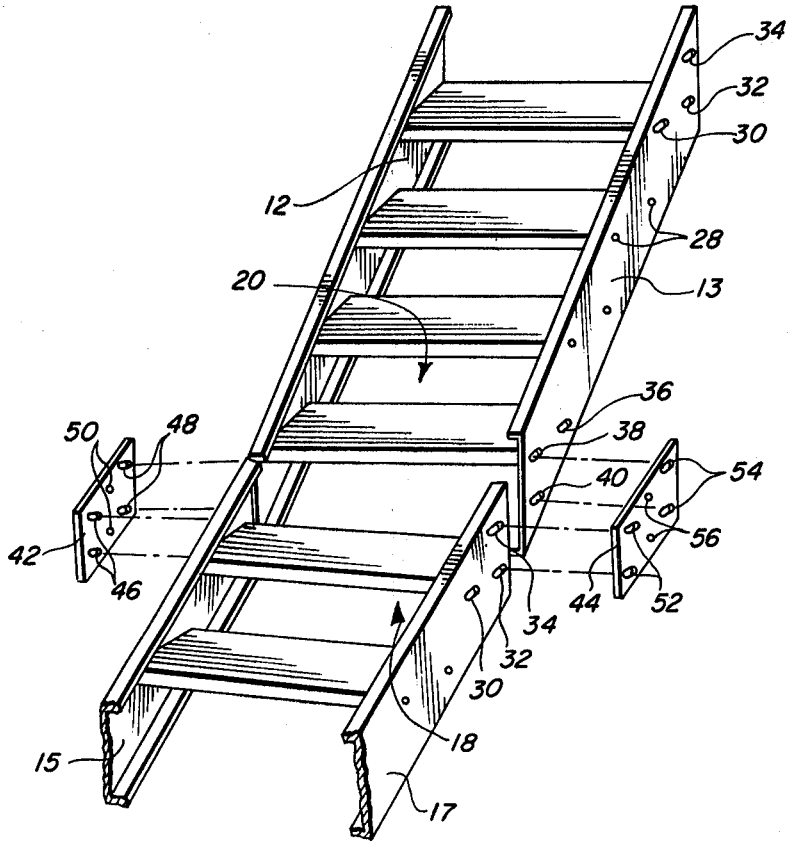
FIG. 3 is a partially exploded perspective view showing the connection of two adjacent stairway sections.

With reference to FIG. 3, adjacent stairway sections 10, 11 are joined by utilizing a first splice plate 42 and a second splice plate 44 comprised of sheet metal. First splice plate 42 is provided with two pairs of outer holes 46, 48 for joining the upper and lower first stringers 12, 15. The first splice plate 42 also is provided with two central holes 50 for a purpose to be hereinafter described.

The first stringers 12, 15 are joined by placing the first splice plate 42 on the outer walls of the first stringers 12, 15 to be joined with holes 48 in the first splice plate 42 aligned with the slots 38, 40 in the upper first stringer 12, and the holes 46 in the first splice plate 42 aligned with slots 32, 34 in the lower first stringer 15. The forward holes 26 of the bottommost stair 20 of the upper stairway section 10 is also aligned with slot 38 in the first stringer 12. The rearward hole 26 of the uppermost stair 18 of the lower stairway 11 is also aligned with slot 32 of the first stringer 15. The first splice plate 42, upper and lower first stringers 12, 15 and stairs 18, 20 are secured using four bolts (not shown) which pass through the above-described aligned holes. The securing of the uppermost stair 18 and bottommost stair 20 to the first stringers 12, 15 is completed by means of bolts (not shown) which pass through hole 30 in lower first stringer 15 and the forward hole 26 in uppermost stair 18 of stairway section 11 and hole 36 in upper first stringer 12 and the rearward hole 36 in the bottommost stair 20 of stairway section 10.

Second splice plate 44 is provided with two pairs of outer slots 52, 54 for joining the upper and lower second stringers 13, 17. The second splice plate 44 is also provided with two central holes 56 for a purpose to be hereinafter described. The second stringers 13, 17 are joined by placing the second splice plate 44 on the outer walls of the second stringers 13, 17 to be joined with the slots 54 in the second splice plate 44 aligned with slots 38, 40 in the upper second stringer 13, and the slots 52 in the second splice plate 44 aligned with slots 32, 34 in the lower second stringer 17. The rearward hole 26 of the uppermost stair 18 of the lower stairway section 11 is also aligned with slot 32 of the second stringer 17. The forward hole 26 of the bottommost stair 20 of the upper stairway section 10 is also aligned with slot 38 in the second stringer 13. The second splice plate 44, upper and lower second stringers 13, 17 and stairs 18, 20 are secured using four bolts (not shown) which pass through the above-described aligned holes. The securing of the uppermost stair 18 and bottommost stair 20 to the second stringers 13, 17 is completed by means of bolts (not shown) which pass through hole 30 in lower second stringer 17 and the forward hole 26 in uppermost stair 18 of stairway section 11 and hole 36 in second stringer 13 and the rearward hole 26 in the bottommost stair 20 of stairway section 10.

In the embodiment described above, the uppermost and bottommost stair 18, 20 of each stairway section 10 is secured to the stringers 12, 13, 15, 17 using the same bolts that secure the first and second splice plates 42, 44 to the stringers 12, 13, 15, 17. It will be appreciated by anyone skilled in the art that the uppermost and bottommost stairs 18, 20 could also be independently secured in the same manner as intermediate stairs 16.

Substantially, any suitable material may be employed in fabricating the first and second splice plates 42, 44, but galvanized steel has been found to be especially satisfactory.

As many stairway sections as are necessary for the required height are joined in the foregoing manner. The securing bolts (not shown) described above are only loosely tightened until the stairway system is installed on the structure. This allows the bolts to slidable move in the provided slots thereby allowing the stairway system to adjust to the curvature of the circular structure, or other structure having non-linear walls, during installation.

Figure 4:
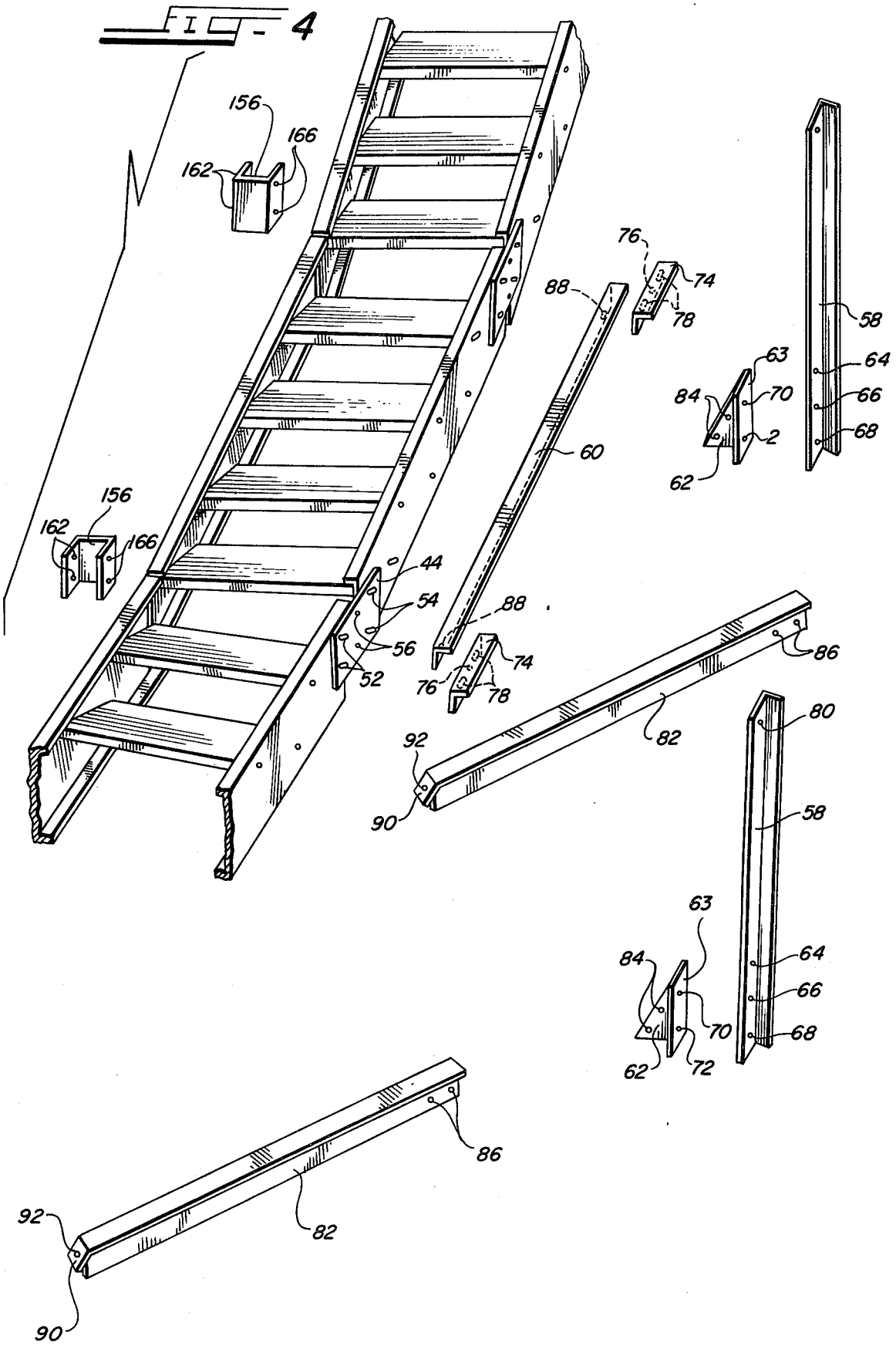
FIG. 4 is a partially exploded perspective view showing three adjacent stairway sections and the balusters, handrails stand-off brackets and braces.

As shown in FIG. 4, the stairway system is provided with balusters 58, handrails 60 and braces 82 formed of metal angle. A brace bracket 62, formed from metal plate of substantially triangular shape with a flange 63 formed on the front face thereof is placed on the outside of the second splice plate 44 with hole 70 in flange 63 aligned with the lower hole 56 in the second splice plate 44. The hole 64 in the baluster 58 is aligned with the upper hole 56 in the second splice plate 44 and the holes 66, 68 are aligned with holes 70, 72 in the flange 63 of the brace bracket 62. The brace bracket 62 and baluster 58 are then secured to the second splice plate 44 by means of three bolts (not shown) which pass through the aligned holes described above. A brace 82 formed of metal angle is secured to brace bracket 62 by means of a pair of bolts (not shown) which pass through holes 84 in brace bracket 62 and holes 86 in brace 82.

The handrail 60 is mounted to the balusters 58 by utilizing two handrail splices 74 comprised of metal angle. The handrail splice 74 is provided with a central hole 76 and a slot 78 on each end thereof. The handrail splice 74 is secured to the baluster 58 by means of a bolt (not shown) which passes through hole 76 in the handrail splice 74 and hole 80 in the baluster 58. The handrail 60 is then secured to the two handrail splices 74 by means of two bolts (not shown) which pass through holes 88 in the handrail 60 and slots 78 in handrail splices 74.

Substantially, any suitable material may be employed in fabricating the handrail 60, balusters 58, handrail splice 74, brace 82 and brace bracket 62, but galvanized steel has been found to be especially satisfactory.

Figures 5, 6:
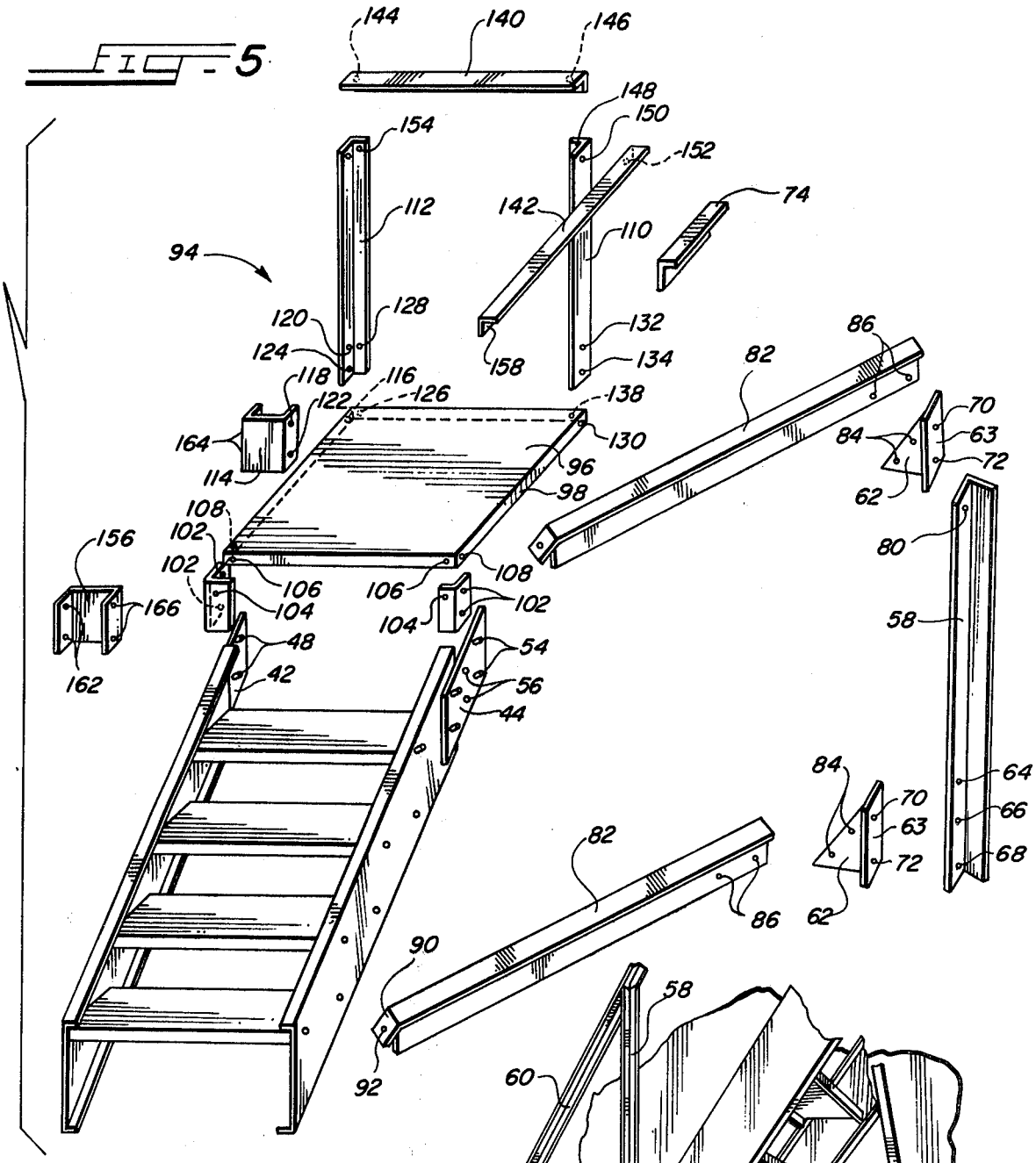
FIG. 5 is a partially exploded perspective view of a top stairway section and the platform section.
FIG. 6 is another perspective view of the stairway mounted on a circular structure.

As shown in FIG. 5, a platform section 94 is provided at the top of the stairway system. The platform section 94 is comprised of a deck 96 of sheet metal of uniform thickness and having downwardly turned flanges 98 formed on the four sides thereof.

Substantially, any material may be employed in fabricating the deck 96, but galvanized steel has been found to be especially satisfactory.

The deck 96 is secured to the first and second splice plates 42, 44 of the stairway section 10 by means of two corner brackets 100, 101 formed of metal angle. The two corner brackets 100, 101 are secured to deck 96 by means of two bolts (not shown) which pass through holes 104 in corner brackets 100, 101 and holes 106 in deck 96 and thereby aligning holes 108 in deck 96 with upper holes 102 in corner brackets 100, 101. The deck is secured to the second stringer 13 of the stairway system by means of two bolts (not shown) which pass through slots 54 in second splice plate 44 and holes 102 in corner bracket 100 and thereby hole 108 in deck 96. The deck is secured to the first stringer 12 of the stairway system by means of two bolts (not shown) which pass through holes 48 in the first splice plate 42 and holes 102 in corner bracket 101 and thereby hole 108 in deck 96.

Baluster 112 is secured to the deck 96 by means of a bolt (not shown) passing through hole 118 in platform stand-off bracket 114, hole 120 in baluster 112 and hole 116 in deck 96; and a bolt (not shown) passing through hole 128 in baluster 112 and hole 126 in deck 96. The platform stand-off bracket 114 is further secured to baluster 112 by means of a bolt (not shown) which passes through hole 122 in platform stand-off bracket 114 and hole 124 in baluster 112.

Baluster 110 is secured to the deck 96 by means of a bolt (not shown) passing through hole 132 in baluster 110, hole 70 in flange 63 of brace bracket 62 and hole 130 in deck 96 and a bolt (not shown) passing through hole 136 in baluster 110 and hole 138 in deck 96. The brace bracket 62 is further secured to baluster 110 by means of a bolt (not shown) which passes through hole 134 in baluster 110 and hole 72 in flange 63 of brace bracket 62. The brace 82 is secured to brace bracket 62 by means of a pair of bolts (not shown) which pass through holes 84 in brace bracket 62 and holes 86 in brace 82.

Handrail 140 is secured to baluster 112 by means of a bolt (not shown) which passes through hole 144 in handrail 140 and hole 154 in baluster 112; and to baluster 110 by means of a bolt (not shown) which passes through hole 146 in handrail 140 and hole 148 in baluster 110. Handrail 142 is secured to baluster 110 by means of a bolt (not shown) which passes through hole 152 in handrail 142 and hole 150 in baluster 110. Handrail 142 is secured to handrail splice 74 by means of a bolt (not shown) which passes through hole 158 in handrail 142 and slot 78 in handrail splice 74.

Figure 1:
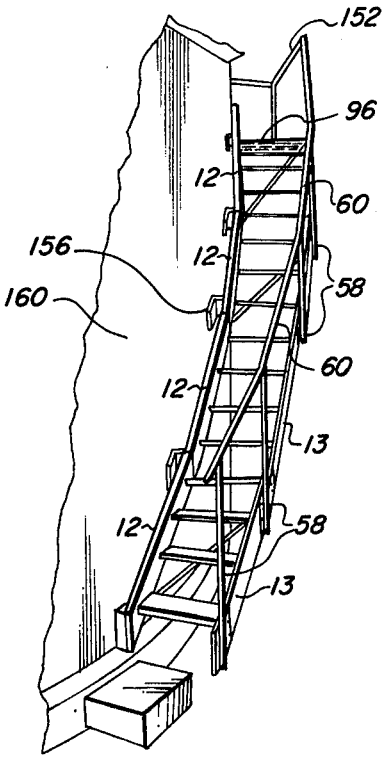
FIG. 1 is a perspective view of the stairway mounted on a circular structure.

Referring to FIGS. 1 and 6 the stairway system is secured to the structure 160 by means of the stand-off brackets 156, platform stand-off brackets 114, and brace 82.

The stand-off brackets 156 are secured to the first splice plates 142 by means of two bolts (not shown) which pass through holes 166 in the stand-off bracket 156 and central holes 50 in the first splice plate 142. The stand-off bracket 156 is secured to the wall of the structure 160 by means of bolts (not shown) which pass through holes 162 in stand-off bracket 156. Platform stand-off bracket 114 is secured to the wall of the structure 160 by means of bolts (not shown) which pass through holes 164 in stand-off bracket 114. The braces 82 are secured to the structure 160 by means of bolts (not shown) which pass through holes 92 in tab 90 at the base of braces 82.

The stairway sections can be mounted on the non-linear structure in either a clockwise or counterclockwise direction. This is accomplished by disposing the second stringer 13 on the side of the stairway 10 nearest the wall of the structure and the first stringer 12 on the opposing or outer side of the stairway 10. The first stringers 12, 15 would now be joined with second splice plate 44 and the second stringers would be joined with first splice plate 42.

In the embodiment shown in FIGS. 1–6, the stairway system of this invention is shown in connection with a cylindrical storage bin. However, it may also be employed with structures having other non-linear wall structures such as oval or ellipsoidal structures, and certain polygonal structures as well.

Accordingly, the modular stairway apparatus of this invention fulfills a significant role in overcoming the disadvantages of prior art efforts to prefabricate stairways for structures having curved or non-linear walls. In particular, it provides a practical stairway system which utilizes prefabricated straight modular component sections which can be installed on circular structures of different diameter and therefore different radii of curvature in either a clockwise or counterclockwise direction.

In addition, the stairway system can be easily and inexpensively manufactured, shipped dsassembled and easily assembled and installed with a minimum of labor without the necessity of welding. Furthermore, the individual components can also be conveniently and economically replaced when necessary due to the sectional construction and bolted installation.

Moreover, the sectional components can have dimensions and corresponding hole punchings which match the normal bolt spacings on standard circular structures such as grain storage bins.

At the same time a stairway system is obtained which is safer to climb than the ladder systems which are frequently utilized due to the lack of inexpensive convenient prefabricated stairway systems.

I claim:

1. A modular stairway system for structures having non-linear walls comprising:

a plurality of first stringer means;

a plurality of first connecting means for joining the first stringers;

a plurality of second stringer means horizontally spaced from and parallel to the first stringer means;

a plurality of adjustable second connecting means for adjustably joining the second stringers such that the combination of first and second stringers conform to the curvature of the structure;

a plurality of stairs horizontally interposed between the first and second stringers;

a stair mounting means for securing the stairs to the first and second stringers;

mounting bracket means for securing the first stringers to the structure; and brace means for supporting the second stringer to the structure, whereby the stairway system may be easily installed on structures having non-linear walls.

2. An apparatus, as claimed in claim 1, wherein the ends of the side portions of the first and second stringers have spaced holes.

3. An apparatus, as claimed in claim 2, wherein the adjustable second connecting means comprises a metal plate having spaced slots that align with the spaced holes in the ends of the second stringers.

4. An apparatus, as claimed in claim 2, wherein the first connecting means comprises a metal plate having spaced holes that align with the spaced holes in the ends of the first stringers.

5. An apparatus, as claimed in claim 4, wherein spacing of the spaced holes conform to the normal bolt spacing on standardized structures having non-linear walls.

6. An apparatus, as claimed in claim 1, further comprising:

a platform section;

a platform connecting means for joining the platform section to the first and second stringers;

a platform mounting bracket means for securing the platform to the structure; and platform brace means for supporting the platform to the structure.

7. An apparatus, as claimed in claim 6, further comprising:

a plurality of balusters secured to the second stringers and platform section;

a plurality of adjustable handrail splices secured to the balusters; and a plurality of handrails adjustably secured to the handrail splices.

* * * * *

UNITED STATES PATENT AND TRADEMARK OFFICE

CERTIFICATE OF CORRECTION

PATENT NO. : 4,143,740

DATED : March 13, 1979

INVENTOR(S) : Wesley D. Matthews

It is certified that error appears in the above-identified patent and that said Letters Patent are hereby corrected as shown below:

In the Heading

"[73] Assignee: Floyd G. Matthews, Mechanicsburg, Ill." should be -- [73] Assignee: Floyd G. Matthews, Mechanicsburg, Ill. a part interest --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*